US008876674B2

(12) United States Patent
Webb et al.

(10) Patent No.: US 8,876,674 B2
(45) Date of Patent: Nov. 4, 2014

(54) SELECTABLE WEIGHT STACK

(75) Inventors: Gregory M. Webb, Independence, VA (US); Eric D. Golesh, Arvada, CO (US)

(73) Assignee: Nautilus, Inc., Vancouver, WA (US)

( * ) Notice: Subject to any disclaimer, the term of this patent is extended or adjusted under 35 U.S.C. 154(b) by 595 days.

(21) Appl. No.: 13/077,173

(22) Filed: Mar. 31, 2011

(65) Prior Publication Data

US 2012/0010055 A1 Jan. 12, 2012

Related U.S. Application Data

(60) Provisional application No. 61/319,628, filed on Mar. 31, 2010.

(51) Int. Cl.
*A63B 21/00* (2006.01)

(52) U.S. Cl.
USPC ..... 482/99; 482/98; 482/102

(58) Field of Classification Search
USPC ..... 482/106, 108, 96, 98, 99
See application file for complete search history.

(56) References Cited

U.S. PATENT DOCUMENTS

| | | | |
|---|---|---|---|
| 2,855,199 | A | 10/1958 | Noland et al. |
| 2,921,791 | A | 1/1960 | Berne |
| 3,306,611 | A | 2/1967 | Gaul |
| 3,588,101 | A | 6/1971 | Jungreis |
| 3,638,941 | A | 2/1972 | Kulkens |
| 3,662,602 | A | 5/1972 | Weiss |
| 3,822,599 | A | 7/1974 | Brentham |
| 3,856,297 | A | 12/1974 | Schnell |
| 4,076,236 | A | 2/1978 | Ionel |
| 4,290,597 | A | 9/1981 | Schleffendorf |
| 4,336,934 | A | 6/1982 | Hanagan et al. |
| 4,357,010 | A | 11/1982 | Telle |
| RE31,113 | E | 12/1982 | Coker et al. |

(Continued)

FOREIGN PATENT DOCUMENTS

| | | | |
|---|---|---|---|
| CN | 2430184 | Y | 5/2001 |
| EP | 0121902 | A1 | 10/1984 |

(Continued)

OTHER PUBLICATIONS

PCT International Search Report of corresponding PCT International Application No. PCT/US2011/030831 dated Jun. 1, 2011, 2 pages.

(Continued)

*Primary Examiner* — Jerome W Donnelly
(74) *Attorney, Agent, or Firm* — Dorsey & Whitney LLP

(57) ABSTRACT

A weight stack for an exercise machine may include one or more primary and secondary load elements that are selectively joined to a weight carriage. The load elements may be supported from below by one or more support beams and positioned at spaced apart locations on the support beam when the weight carriage is located at its rest position or when the load elements are not joined to the weight carriage during an exercise. The load elements may include engagement surfaces that engage the beam either directly by contacting the beam or indirectly via a divider structure positioned between the load elements and the beam. For some load elements, the engagement surfaces define a portion of a slot in the load element. The exercise machine may further include a single guide pole that constrains the weight carriage to move substantially linearly and vertically relative to the exercise machine's support frame.

12 Claims, 9 Drawing Sheets

(56) References Cited

U.S. PATENT DOCUMENTS

| | | | |
|---|---|---|---|
| 4,405,128 | A | 9/1983 | McLaughlin et al. |
| 4,426,077 | A | 1/1984 | Becker |
| 4,453,710 | A | 6/1984 | Plötz |
| 4,478,411 | A | 10/1984 | Baldwin |
| 4,502,681 | A | 3/1985 | Blomqvist |
| 4,529,197 | A | 7/1985 | Gogarty |
| 4,529,198 | A | 7/1985 | Hettick, Jr. |
| 4,538,805 | A | 9/1985 | Parviainen |
| 4,546,971 | A | 10/1985 | Raasoch |
| 4,598,908 | A | 7/1986 | Morgan |
| 4,627,614 | A | 12/1986 | de Angeli |
| 4,627,615 | A | 12/1986 | Nurkowski |
| 4,700,944 | A | 10/1987 | Sterba et al. |
| 4,722,522 | A | 2/1988 | Lundgren |
| 4,756,526 | A | 7/1988 | Broussard |
| 4,787,629 | A | 11/1988 | DeMyer |
| 4,804,179 | A | 2/1989 | Murphy |
| 4,822,034 | A | 4/1989 | Shields |
| 4,834,396 | A | 5/1989 | Schnell |
| 4,854,578 | A | 8/1989 | Fulks |
| 4,858,915 | A | 8/1989 | Szabo |
| 4,861,025 | A | 8/1989 | Rockwell |
| 4,880,229 | A | 11/1989 | Broussard |
| 4,902,007 | A | 2/1990 | Ferrari |
| 4,944,511 | A | 7/1990 | Francis |
| 4,951,939 | A | 8/1990 | Peters |
| 4,971,305 | A | 11/1990 | Rennex |
| 4,982,957 | A | 1/1991 | Shields |
| 5,002,271 | A | 3/1991 | Gonzales |
| 5,050,873 | A | 9/1991 | Jones |
| D321,025 | S | 10/1991 | Jones |
| D321,026 | S | 10/1991 | Jones |
| D321,027 | S | 10/1991 | Jones |
| D321,028 | S | 10/1991 | Jones |
| 5,060,938 | A | 10/1991 | Hawley, Jr. |
| D321,387 | S | 11/1991 | Jones |
| D321,389 | S | 11/1991 | Jones |
| D321,390 | S | 11/1991 | Jones |
| D321,391 | S | 11/1991 | Jones |
| 5,066,003 | A | 11/1991 | Jones |
| 5,066,004 | A | 11/1991 | Jones |
| 5,094,450 | A | 3/1992 | Stearns |
| 5,106,080 | A | 4/1992 | Jones |
| 5,116,297 | A | 5/1992 | Stonecipher |
| 5,123,885 | A | 6/1992 | Shields |
| 5,125,881 | A | 6/1992 | Jones |
| 5,135,449 | A | 8/1992 | Jones |
| 5,135,456 | A | 8/1992 | Jones |
| 5,171,198 | A | 12/1992 | Jones |
| 5,180,354 | A | 1/1993 | Jones |
| 5,181,896 | A | 1/1993 | Jones |
| 5,201,694 | A | 4/1993 | Zappel |
| 5,217,422 | A | 6/1993 | Domzalski |
| 5,230,680 | A | 7/1993 | Wu |
| 5,263,915 | A | 11/1993 | Habing |
| 5,273,504 | A | 12/1993 | Jones |
| 5,273,505 | A | 12/1993 | Jones |
| 5,306,221 | A | 4/1994 | Itaru |
| 5,308,303 | A | 5/1994 | Rawls et al. |
| 5,336,148 | A | 8/1994 | Ish, III |
| 5,380,258 | A | 1/1995 | Hawley, Jr. |
| 5,387,170 | A | 2/1995 | Rawls et al. |
| D359,778 | S | 6/1995 | Towley, III et al. |
| 5,429,570 | A | 7/1995 | Beyer |
| 5,484,367 | A | 1/1996 | Martinez |
| 5,554,084 | A | 9/1996 | Jones |
| 5,554,089 | A | 9/1996 | Jones |
| 5,554,090 | A | 9/1996 | Jones |
| 5,562,577 | A | 10/1996 | Nichols, Sr. et al. |
| 5,569,139 | A | 10/1996 | Civie et al. |
| 5,628,715 | A | 5/1997 | Simonson |
| 5,632,710 | A | 5/1997 | England et al. |
| 5,637,064 | A | 6/1997 | Olson et al. |
| 5,749,813 | A | 5/1998 | Domzalski |
| 5,769,757 | A | 6/1998 | Fulks |
| 5,769,762 | A | 6/1998 | Towley, III et al. |
| 5,779,604 | A | 7/1998 | Towley, III et al. |
| 5,788,615 | A | 8/1998 | Jones |
| 5,788,616 | A | 8/1998 | Polidi |
| 5,810,701 | A | 9/1998 | Ellis et al. |
| 5,839,997 | A | 11/1998 | Roth et al. |
| 5,876,313 | A | 3/1999 | Krull |
| 5,971,899 | A | 10/1999 | Towley, III et al. |
| 6,015,367 | A | 1/2000 | Scaramucci |
| 6,033,350 | A | 3/2000 | Krull |
| D422,654 | S | 4/2000 | Chen |
| 6,045,491 | A | 4/2000 | McNergney et al. |
| 6,083,144 | A | 7/2000 | Towley, III et al. |
| 6,095,955 | A | 8/2000 | Lee |
| 6,099,442 | A | 8/2000 | Krull |
| 6,117,049 | A | 9/2000 | Lowe |
| 6,149,558 | A | 11/2000 | Chen |
| 6,174,265 | B1 | 1/2001 | Alessandri |
| 6,186,927 | B1 | 2/2001 | Krull |
| 6,186,928 | B1 | 2/2001 | Chen |
| 6,196,952 | B1 | 3/2001 | Chen |
| 6,203,474 | B1 | 3/2001 | Jones |
| 6,228,003 | B1 | 5/2001 | Hald et al. |
| 6,261,022 | B1 | 7/2001 | Dalebout et al. |
| 6,322,481 | B1 | 11/2001 | Krull |
| 6,350,221 | B1 | 2/2002 | Krull |
| 6,364,815 | B1 | 4/2002 | Lapcevic |
| 6,402,666 | B2 | 6/2002 | Krull |
| 6,416,446 | B1 | 7/2002 | Krull |
| 6,422,979 | B1 | 7/2002 | Krull |
| 6,436,013 | B1 | 8/2002 | Krull |
| 6,440,044 | B1 | 8/2002 | Francis et al. |
| 6,443,874 | B1 | 9/2002 | Bennett |
| 6,482,139 | B1 | 11/2002 | Haag |
| 6,500,101 | B1 | 12/2002 | Chen |
| 6,500,106 | B1 | 12/2002 | Fulks |
| 6,517,468 | B1 | 2/2003 | Lapcevic |
| 6,540,650 | B1 | 4/2003 | Krull |
| 6,561,960 | B2 | 5/2003 | Webber |
| 6,595,902 | B1 | 7/2003 | Savage et al. |
| 6,605,024 | B2 | 8/2003 | Stearns |
| 6,629,910 | B1 | 10/2003 | Krull |
| 6,656,093 | B2 | 12/2003 | Chen |
| 6,669,606 | B2 | 12/2003 | Krull |
| 6,679,816 | B1 | 1/2004 | Krull |
| 6,682,464 | B2 | 1/2004 | Shifferaw |
| 6,719,672 | B1 | 4/2004 | Ellis et al. |
| 6,719,674 | B2 | 4/2004 | Krull |
| 6,733,424 | B2 | 5/2004 | Krull |
| 6,746,381 | B2 | 6/2004 | Krull |
| 6,749,547 | B2 | 6/2004 | Krull |
| 6,802,800 | B1 | 10/2004 | Hobson |
| D498,272 | S | 11/2004 | Sanford-Schwentke et al. |
| D500,820 | S | 1/2005 | Krull |
| 6,855,097 | B2 | 2/2005 | Krull |
| 6,872,173 | B2 | 3/2005 | Krull |
| 6,902,516 | B2 | 6/2005 | Krull |
| D508,628 | S | 8/2005 | Crawford et al. |
| 6,974,405 | B2 | 12/2005 | Krull |
| 7,018,325 | B2 | 3/2006 | Shifferaw |
| D521,087 | S | 5/2006 | Francis |
| 7,066,867 | B2 | 6/2006 | Krull |
| 7,077,790 | B1 | 7/2006 | Krull |
| 7,077,791 | B2 | 7/2006 | Krull |
| 7,083,554 | B1 | 8/2006 | Lo Presti |
| 7,090,625 | B2 | 8/2006 | Chermack |
| D528,173 | S | 9/2006 | Flick et al. |
| D528,611 | S | 9/2006 | Flick |
| 7,112,163 | B2 | 9/2006 | Krull |
| 7,121,988 | B2 | 10/2006 | Walkerdine |
| 7,137,931 | B2 | 11/2006 | Liu |
| 7,137,932 | B2 | 11/2006 | Doudiet |
| D533,910 | S | 12/2006 | Dibble et al. |
| 7,153,243 | B1 | 12/2006 | Krull |
| D536,752 | S | 2/2007 | Walkerdine |
| 7,172,536 | B2 | 2/2007 | Liu |
| 7,182,715 | B2 | 2/2007 | Anderson |
| 7,189,190 | B2 | 3/2007 | Lamar et al. |
| D540,405 | S | 4/2007 | Crawford et al. |

(56) References Cited

U.S. PATENT DOCUMENTS

| | | | | |
|---|---|---|---|---|
| D540,894 | S | 4/2007 | Crawford et al. | |
| 7,201,711 | B2 | 4/2007 | Towley, III et al. | |
| 7,223,214 | B2 | 5/2007 | Chen | |
| 7,229,391 | B2 | 6/2007 | Francis | |
| 7,252,627 | B2 | 8/2007 | Carter | |
| 7,261,678 | B2 | 8/2007 | Crawford et al. | |
| D550,789 | S | 9/2007 | Dibble et al. | |
| 7,285,078 | B1 | 10/2007 | Liu | |
| 7,291,098 | B1 | 11/2007 | Krull | |
| 7,306,549 | B2 | 12/2007 | Francis | |
| 7,367,927 | B2 | 5/2008 | Krull | |
| 7,377,885 | B2 | 5/2008 | Doudiet | |
| 7,387,595 | B2 | 6/2008 | Towley, III et al. | |
| 7,387,597 | B2 | 6/2008 | Krull | |
| 7,413,532 | B1 | 8/2008 | Monsrud et al. | |
| 7,413,533 | B2 | 8/2008 | Lin | |
| 7,429,235 | B2 | 9/2008 | Lin | |
| 7,452,312 | B2 | 11/2008 | Liu | |
| 7,485,077 | B2 | 2/2009 | Chen | |
| 7,507,189 | B2 | 3/2009 | Krull | |
| 7,534,199 | B2 | 5/2009 | Krull | |
| 7,540,832 | B2 | 6/2009 | Krull | |
| 7,553,265 | B2 | 6/2009 | Crawford et al. | |
| 7,591,770 | B2 | 9/2009 | Stewart et al. | |
| 7,614,982 | B2 | 11/2009 | Crawford et al. | |
| 7,625,322 | B1 | 12/2009 | Krull | |
| 7,662,074 | B2 | 2/2010 | Webb | |
| 7,736,283 | B2 | 6/2010 | Webb | |
| 7,740,568 | B2 | 6/2010 | Webb | |
| 7,758,478 | B2 | 7/2010 | Golesh et al. | |
| 7,794,373 | B2 | 9/2010 | Crawford et al. | |
| 7,887,468 | B2 | 2/2011 | Ross et al. | |
| 8,002,680 | B2 | 8/2011 | Crawford et al. | |
| 8,016,729 | B2 | 9/2011 | Webb | |
| 2002/0025888 | A1 | 2/2002 | Germanton et al. | |
| 2002/0077230 | A1 | 6/2002 | Lull et al. | |
| 2003/0027697 | A1 | 2/2003 | Baumler | |
| 2003/0092542 | A1 | 5/2003 | Bartholomew et al. | |
| 2003/0148862 | A1 | 8/2003 | Chen et al. | |
| 2003/0199368 | A1 | 10/2003 | Krull | |
| 2004/0005969 | A1 | 1/2004 | Chen | |
| 2004/0018920 | A1* | 1/2004 | Simonson | 482/99 |
| 2004/0023765 | A1 | 2/2004 | Krull | |
| 2004/0220025 | A1 | 11/2004 | Krull | |
| 2005/0079961 | A1 | 4/2005 | Dalebout et al. | |
| 2005/0085351 | A1 | 4/2005 | Kissel | |
| 2006/0025287 | A1 | 2/2006 | Chermack | |
| 2006/0030446 | A1* | 2/2006 | Nozaki et al. | 475/119 |
| 2006/0063650 | A1 | 3/2006 | Francis | |
| 2006/0100069 | A1 | 5/2006 | Dibble et al. | |
| 2006/0105889 | A1 | 5/2006 | Webb | |
| 2006/0116249 | A1 | 6/2006 | Dibble et al. | |
| 2006/0135328 | A1 | 6/2006 | Doudiet | |
| 2006/0205571 | A1 | 9/2006 | Krull | |
| 2006/0211550 | A1 | 9/2006 | Crawford et al. | |
| 2006/0217245 | A1* | 9/2006 | Golesh et al. | 482/94 |
| 2006/0223684 | A1 | 10/2006 | Krull | |
| 2007/0149366 | A1* | 6/2007 | Kuo | 482/98 |
| 2007/0203001 | A1 | 8/2007 | Krull | |
| 2007/0275836 | A1 | 11/2007 | Parviainen | |
| 2008/0026921 | A1 | 1/2008 | Liu | |
| 2008/0039299 | A1 | 2/2008 | Crawford et al. | |
| 2008/0085821 | A1 | 4/2008 | Webb | |
| 2008/0176722 | A1 | 7/2008 | Steffee | |
| 2008/0254952 | A1 | 10/2008 | Webb | |
| 2008/0305936 | A1* | 12/2008 | Cao | 482/98 |
| 2009/0186748 | A1 | 7/2009 | Golesh et al. | |
| 2010/0035736 | A1 | 2/2010 | Crawford et al. | |
| 2011/0003668 | A1 | 1/2011 | Crawford et al. | |

FOREIGN PATENT DOCUMENTS

| | | | |
|---|---|---|---|
| EP | 0617986 | A1 | 10/1994 |
| EP | 1614450 | A1 | 1/2006 |
| FR | 1468902 | | 2/1967 |
| FR | 2613237 | | 10/1988 |
| GB | 2232089 | A | 12/1990 |
| JP | 10118222 | | 5/1998 |
| SE | 455573 | | 7/1988 |
| SU | 1258447 | A | 9/1986 |
| SU | 1367987 | A | 1/1988 |
| SU | 1389789 | A | 4/1988 |
| SU | 1643024 | A | 4/1991 |
| SU | 1780780 | A1 | 12/1992 |
| TW | 379572 | | 1/2000 |

OTHER PUBLICATIONS

Cybex International, Inc., Commercial Strength Systems brochure, 4535 Arm Curl, 5255 Rear Delt, 5281 Arm Curl, Apr. 2000, pp. 9 and 36.

Nautilus Super Smooth Technology, "Equipment Comparison," undated brochure, 1 page.

* cited by examiner

SELECTABLE WEIGHT STACK

CROSS-REFERENCE TO RELATED APPLICATIONS

This application claims the benefit, under 35 U.S.C. §119(e), of U.S. Provisional Patent Application No. 61/319,628, entitled "Selectable Weight Stack" and filed on Mar. 31, 2010, which is hereby incorporated by reference herein in its entirety.

RELATED APPLICATIONS

This application is related to U.S. patent application Ser. No. 13/077,012, entitled "Lockout Mechanism For a Weight Stack Exercise Machine" and filed on Mar. 31, 2011, and U.S. Provisional Patent Application No. 61/319,662, filed on Mar. 31, 2010, and entitled "Lockout Mechanism For a Weight Stack Exercise Machine," which are incorporated by reference herein in their entireties.

FIELD OF THE INVENTION

This invention relates to apparatus and methods associated with weight plates used in a weight stack exercise machine, and more particularly the apparatus associated with moving the weight plates along a single guide rod.

BACKGROUND

Exercise may take several forms including aerobic or cardiovascular training, strength training, flexibility training, and balance training. With particular regard to strength training, two common forms include free weights and exercise machines. In the case of weight training exercise machines, it is common for the machines to include a user interfacing portion such as a graspable bar or handle, a foot press, a leg pad, or other interface. The interface may be connected to a cable or series of cables that may pass through one or a series of pulleys and be connected to one or more weight plates.

A common exercise machine may include a weight stack where each plate in the stack is adapted to slide along two guide rods. The cable in these machines may be attached to a selecting rod passing through the weight stack and having a plurality of holes adapted to align with holes in each of the plates in the stack. A selection pin may be inserted into one of the plurality of holes via a hole in a respective weight plate thereby engaging the selected plate, and all of the plates above it, with the selecting rod. As such, when the user manipulates the user interfacing portion, the cable pulls on the selecting rod causing the selected weights of the weight stack to be lifted along the two guide rods. Accordingly, a user may repetitively lift the selected weights to develop the muscular fatigue common in weight training.

SUMMARY

One embodiment of an exercise machine may include a user engagement mechanism, a frame, a weight carriage, and two or more load elements. The frame may include a first beam. The weight carriage may be operably associated with the user engagement mechanism and movably joined to the frame so that the weight carriage moves substantially vertically and linearly relative to the frame in response to movement of the user engagement mechanism. The weight carriage may include a weight engagement mechanism configured to selectively join to the weight carriage a desired combination of load elements selected from the two or more load elements. Each of the load elements may include a perimeter edge defining an engagement surface. When the weight carriage is positioned in a rest position, each of the load elements may be positioned in a spaced relationship along a longitudinal axis of the first beam and the engagement surfaces for load elements may engage the first beam in such a manner that the first beam supports the weight carriage and the load elements. Each of the load elements can be disengaged from the first beam independently of the other first load elements by selectively joining the first load element to the weight carriage and moving the weight carriage substantially vertically and linearly relative to the frame from the rest position.

Another embodiment of an exercise machine may include a user engagement mechanism, a frame, a weight carriage, two or more load elements and a single guide post. The frame may include a beam. The weight carriage may be operably associated with the user engagement mechanism and movably joined to the frame so that the weight carriage moves substantially vertically and linearly relative to the frame in response to movement of the user engagement mechanism. The weight carriage may include a weight engagement mechanism configured to selectively join to the weight carriage a desired combination of load elements selected from the two or more load elements. When the weight carriage is positioned in a rest position, each of the load elements engage the beam in a spaced relationship along a longitudinal axis of the beam. Each of the load elements can be disengaged from the beam independently of the other load elements by selectively joining the load element to the weight carriage and moving the weight carriage substantially vertically and linearly relative to the frame from the rest position. The single guide post operatively associated with the weight carriage in such a manner that the single guide post constrains the weight carriage to move substantially vertically and linearly relative to the frame.

While multiple embodiments of an exercise machine are disclosed herein, still other embodiments will become apparent to those skilled in the art from the following detailed description, which shows and describes illustrative embodiments of the exercise machine. As will be realized by those of ordinary skill in the art upon reading the following disclosure, the exercise machines described herein are capable of modifications in various aspects, all without departing from the spirit and scope of the described exercise machines. Accordingly, the drawings and detailed description are to be regarded as illustrative in nature and not restrictive.

DETAILED DESCRIPTION

Figure 1:
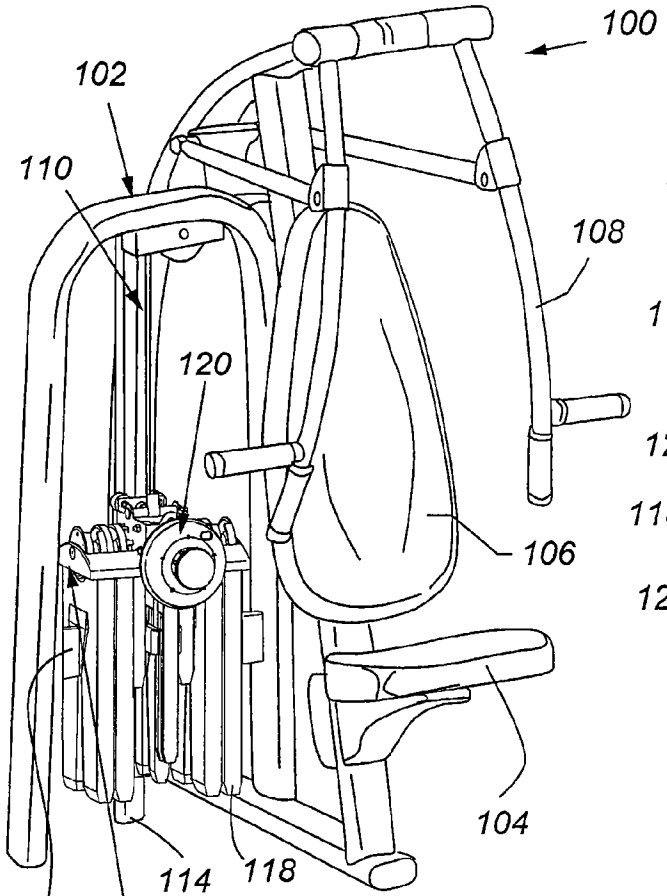
FIG. 1 is a perspective view of an exercise machine with a weight carriage in a rest position.

An example of an exercise machine 100 using a weight stack is shown in FIG. 1. The exercise machine 100 in FIG. 1 is a chest press machine, and includes a frame structure 102 resting on a support structure, such as a floor. The frame structure 102 may include a chair 104 and a backrest 106 for supporting a user, and a pair of handle members 108 for engagement by a user's hands. The handle members 108 may be operably connected with a link and cable system 110, which is in turn operably engaged with a weight carriage 112. The movement of the handle members 108 by the user during exercise actuates the link and cable system 110 to lift and lower the weight carriage 112 along a guide pole 114. The weight stack structure described herein may be used on many different types of exercise equipment other than a chest press machine, including, but not limited to, lower body, upper body, and abdominal exercise machines.

The frame 102 of the exercise machine 100 of FIG. 1 may include a support structure, such as one or more beams or rails 116, for supporting the weight carriage 112 and one or more resistance or load elements 118 when these components are positioned in a rest position. When the weight carriage 112 is in the rest position, the user may operate a load selection mechanism 120 on the weight carriage 112 to select the desired load for the exercise. The load selection mechanism 120 engages one or more of the load elements 118 (e.g., weight plates) to create the load selected by the user. One such load selection mechanism 120 is described below.

The frame 102 of the exercise machine 100 of FIG. 1 may also include a guide pole 114 extending generally between a top portion of the frame 102 and a bottom portion of the frame 102. The guide pole 114 may take the form of a race track oval cross section, and extends in a generally straight line for at least a portion of its length. The weight 112 carriage moves substantially linearly and vertically along a length of the guide pole 114 under the influence of a link and cable system 110 that operably joins the weight carriage 112 to the user engagement mechanism when the user engagement mechanism (e.g., handle members 108 or the like) are actuated by the user. In particular, actuation of the user engagement mechanism by the user causes the weight carriage 112 and any load elements 118 joined to the weight carriage 112 to move away from and back to the rest position. This movement of the carriage 112 and the load elements 118 is generally constrained by the guide pole 114 or rod to occur in a substantially linear and vertical direction relative to the frame 102.

Figure 2:
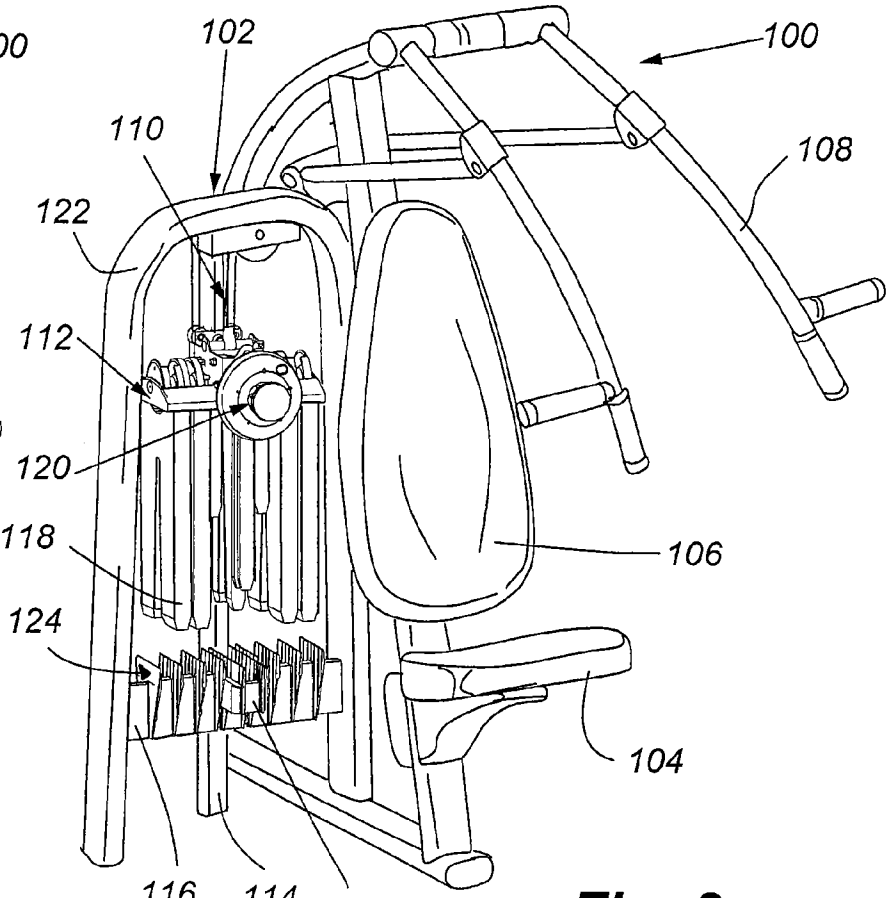
FIG. 2 is a perspective view of the exercise machine of FIG. 1 with the weight carriage moved away from the rest position.

FIG. 2 shows the weight carriage 112 in a loaded position and spaced away from the support structure 116. The support structure 116 may be a support beam or rail that extends generally horizontally between two upright frame members 122. The support beam 116 may be joined to the upright frame members 122 by any suitable connection system used to join beam-like elements to column-like elements. The support beam 116 is sized and configured to be received in a slot extending from a bottom edge and towards a top edge of each load element 118 as described below. The support beam 116 may be further sized and configured to support from below each load element 118 and the weight carriage 112 when the load elements 118 and the weight carriage 112 are positioned at the rest position. This support function is described in more detail hereafter.

Figure 6A:
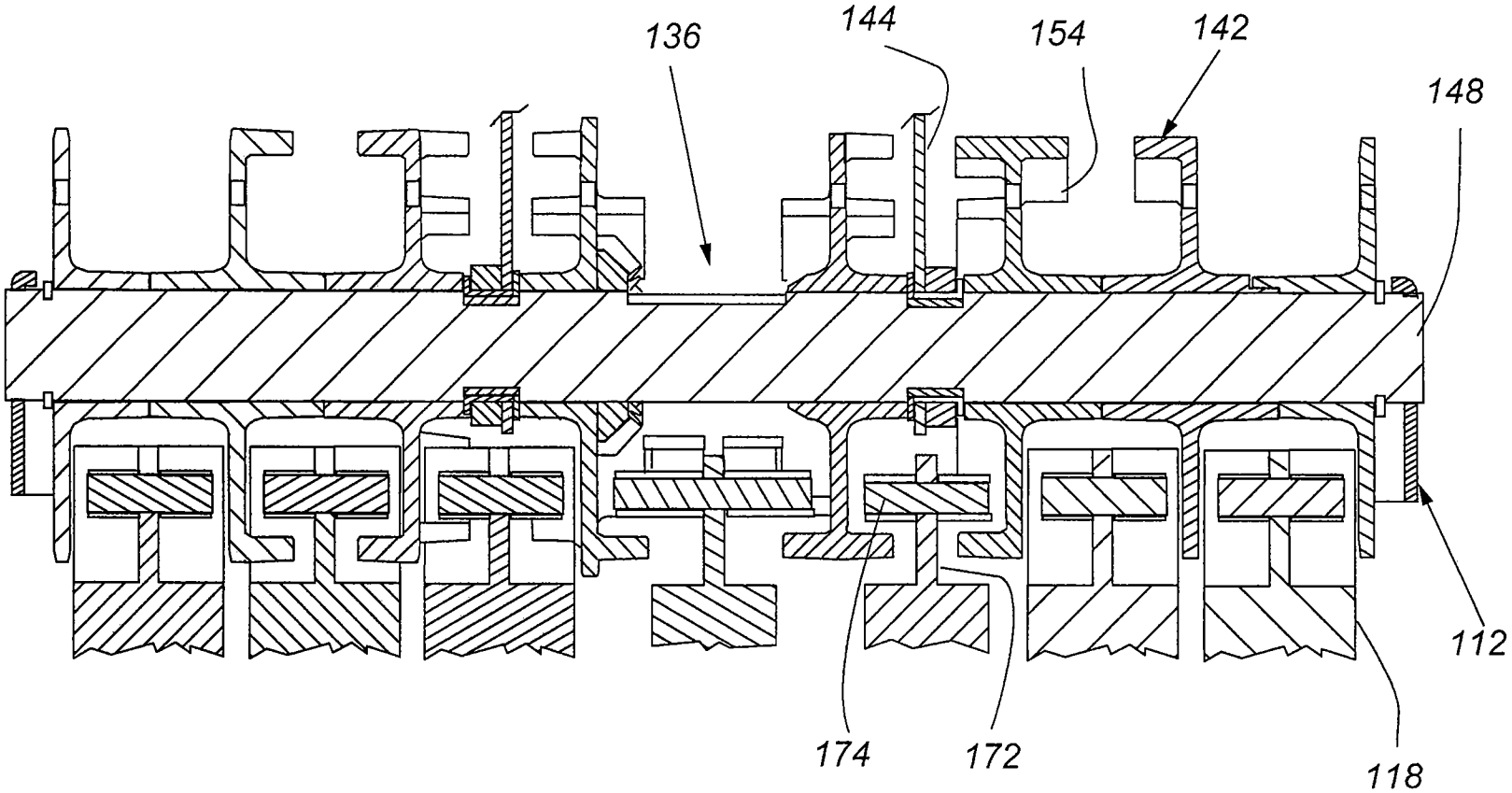
FIG. 6A is a cross-section view of a portion of the exercise machine of FIG. 1, viewed along line 6A-6A in FIG. 3.
Figure 6B:
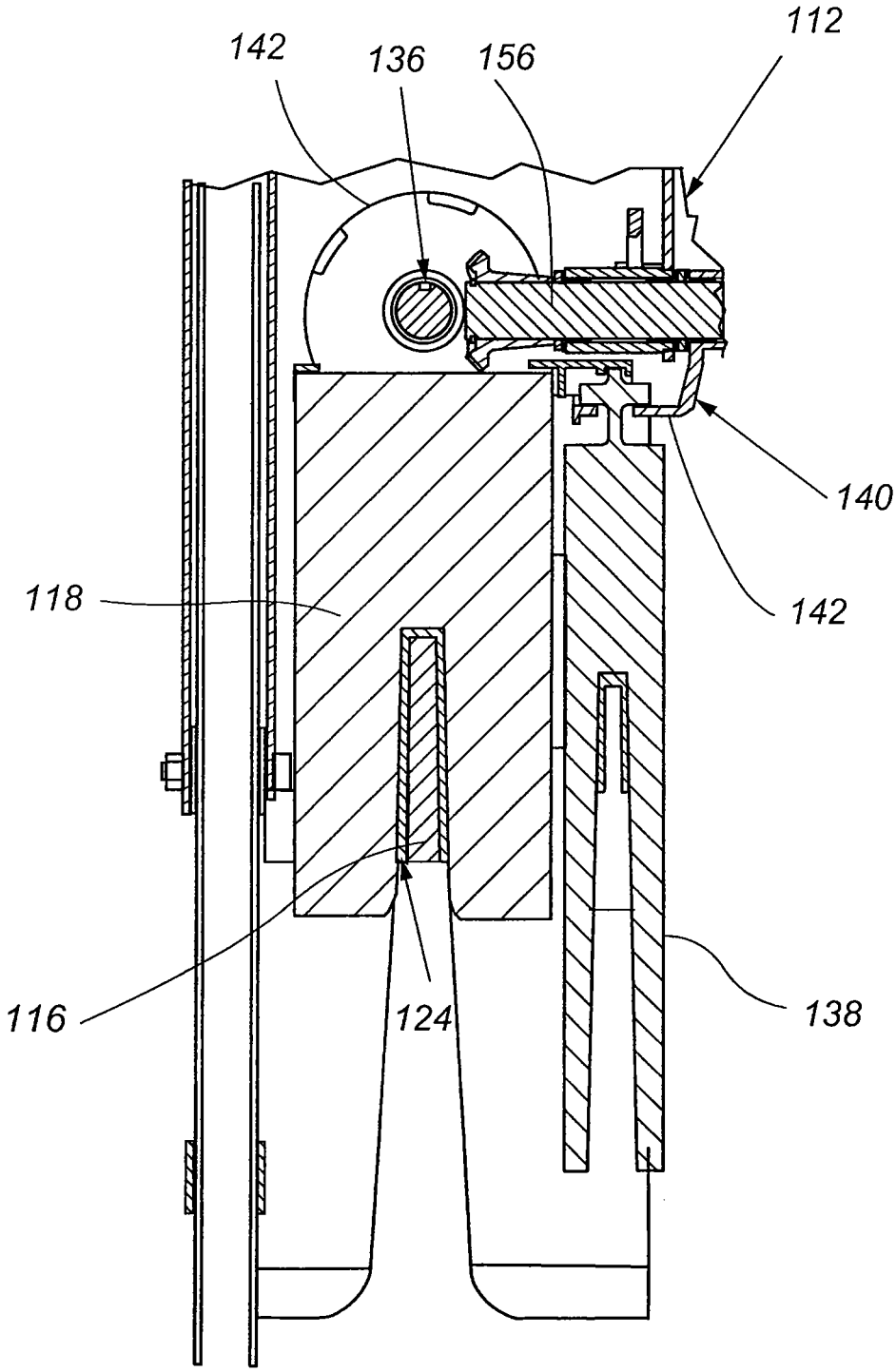
FIG. 6B is a cross-section view of a portion of the exercise machine of FIG. 1, viewed along line 6B-6B in FIG. 3.
Figure 6C:
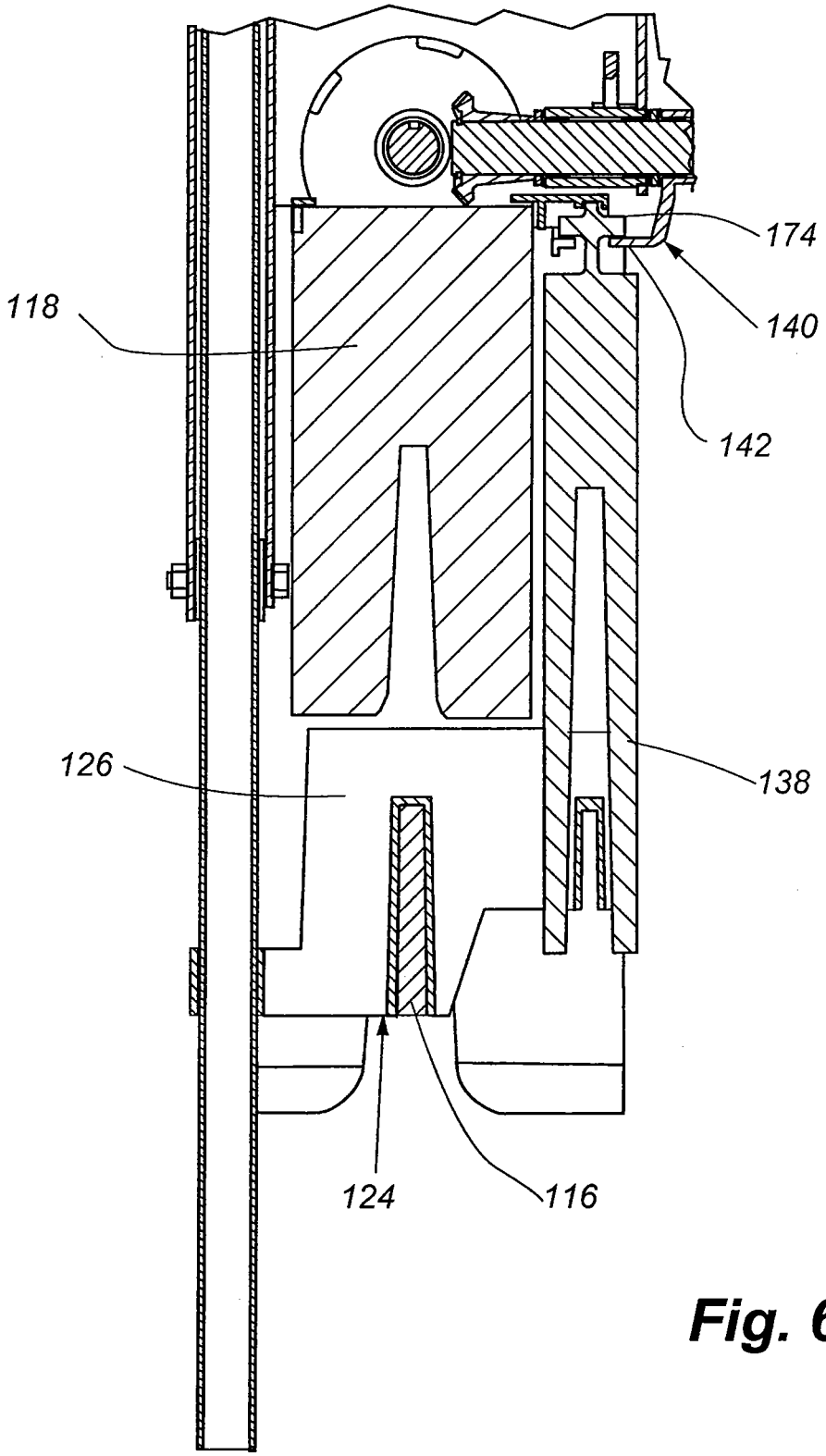
FIG. 6C is a cross-section view similar to the view of FIG. 6C, showing the weight carriage moved from its rest position.

As shown in FIGS. 6B and 6C, a divider structure 124 may be positioned on the support beam 116. The divider structure 124 may include one or more spacer walls 126 that extend upwardly from the support beam 116. The spacer walls 126 help maintain a desired separation between adjacent load elements 118 on the weight carriage 112 when the weight carriage 112 is in the rest position, and help maintain alignment and reduce lateral movement of the load elements 118 (i.e., movement of the load elements 118 relative to the longitudinal axis defined by the beam 116) while the weight carriage 112 is being moved up and down by the user during an exercise. Further, due to the positioning of the load elements 118 along the support beam 116, each of the load elements 118 can be disengaged from the support beam 116 independently of the other load elements 118 by selectively joining the particular load element 116 to the weight carriage 112 using a primary engagement mechanism 136, as described below, and moving the weight carriage 112 substantially vertically and linearly relative to the frame 102 from the rest position of the weight carriage 112.

Figure 3:
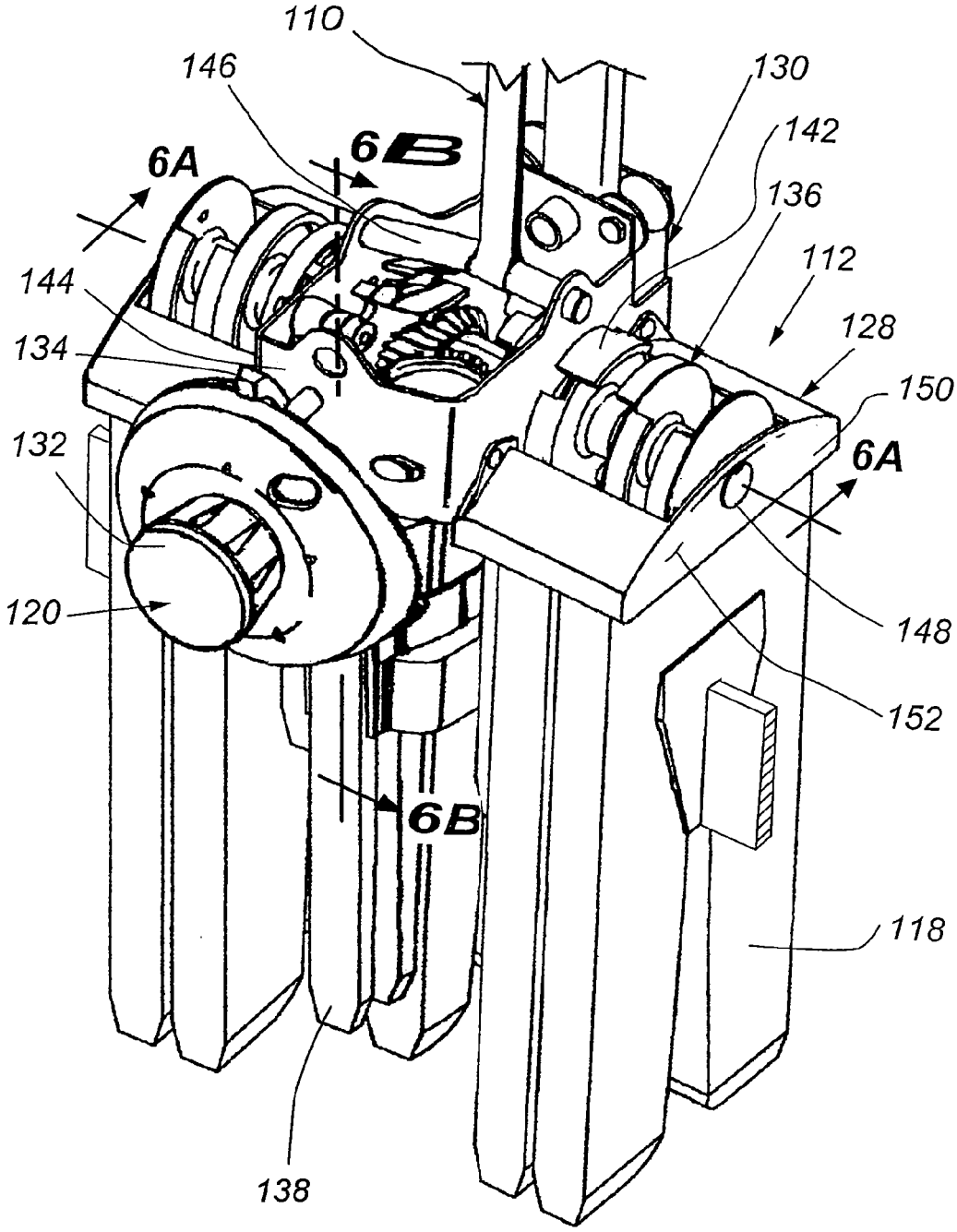
FIG. 3 is perspective view of a portion of the exercise machine of FIG. 1, showing an enlarged view of the weight carriage and the load elements.

The weight carriage 112 is shown in FIG. 3. The weight carriage may include a carriage frame structure 128, the load selection mechanism 120 and a bearing structure 130. The load selection mechanism 120 may include a primary load dial 132 and a secondary load dial 134. By rotating the primary load dial 132, the user can select the desired combination of load elements 118 (i.e., the resistance load) for the exercise. The primary engagement mechanism 136, which is controlled by the primary load dial 132, releasably connects the load elements 118 for creating the desired load to the weight carriage 112. If desired, the user may select additional, smaller load elements 138 for targeting a load in between the minimum weight increments on the primary load dial 132. For instance, and without limitation, if the primary load dial 132 has 10 pound increments, the user may use the secondary load dial 134 to select an additional 5 pound load element 138. Thus, the secondary load dial 134 controls a secondary engagement mechanism 140 (see FIG. 6B) to select the secondary load element or elements 138. Different primary weight increments and/or more (or none) secondary load elements 138 may be utilized in any particular design of a weight stack. The primary and secondary engagement mechanisms 136, 140 include engagement devices 142, which may also be referred to as picking devices, for engaging the necessary primary and secondary load elements 118, 138 to create the desired load chosen by the user. This is described in more detail below.

The frame structure 128 of the weight carriage 112 may include a box frame 144 having a front, rear, and opposing sidewalls attached together to adequately support the lift attachment structure 146, the primary and secondary engagement mechanisms 136, 140 (and any load elements attached thereto), and the bearing structure 130. The lift attachment structure 146 may be located centrally adjacent the top of the box frame 144 to connect to the link and cable system 110. The lift attachment structure 146 allows the box frame 144, and thus the entire weight carriage 112, to be lifted by the effort of the user. The lift attachment structure 146, in one execution, is a rod extending between the opposing left and right sidewalls of the box frame 144, above an elongated shaft 148 of the primary engagement mechanism 136.

Continuing with FIG. 3, the load selection mechanism 120 includes the primary and secondary engagement mechanisms 136, 140 mentioned above. The primary engagement mechanism 136 generally includes the elongated shaft 148, which is rotatably supported by the opposing left and right sidewalls of the box frame 144. A portion of the elongated shaft 148 extends beyond each of these opposing sidewalls. Supplemental U-shaped frame members 150 may be attached to and extend from the opposing left and right sidewalls of the box frame 144. The base 152 of the U-shape of each supplemental frame member 150 supports one of each of the opposing ends of the elongated shaft 148. The bottom surface of the supplementary frame members 150 define short downwardly-depending walls that fit between the load elements 118 to further aid in spacing and alignment of the load elements 118.

As shown in more detail in FIGS. 3 and 6A, the primary engagement mechanism 136 includes multiple engagement devices 142 aligned along the longitudinal shaft 148. The engagement devices 142 are actuated by using the primary load dial 132 to engage desired load elements 118 to create the load selected by the user. In one execution, the engagement devices 142 are discs that rotate with the shaft 148 on which they are positioned. The discs are located inside and outside of the box frame 144, and are keyed together to rotate as one. The periphery of each of the discs has a flange 154, or rim, extending axially, and for all but the end discs, the flanges 154 extend in both axial directions. The flanges 154 may extend to different amounts around the periphery of the discs. The amount of the arc of the perimeter about which each flange 154 extends depends on the combination of load elements 118 to be engaged by the primary engagement mechanism 136 for the weight selected by the user using the primary load dial 132. The abutting flange lengths on each adjacent disc are generally the same because adjacent discs work together to engage the top edge of individual load elements 118, as is discussed in more detail below. The secondary engagement mechanism 140 engages the top edge of the secondary load element 138 in the same manner, but is not associated with the elongated shaft 148 on which the primary engagement devices 142 are positioned. This will be described in more detail below.

Figure 4:
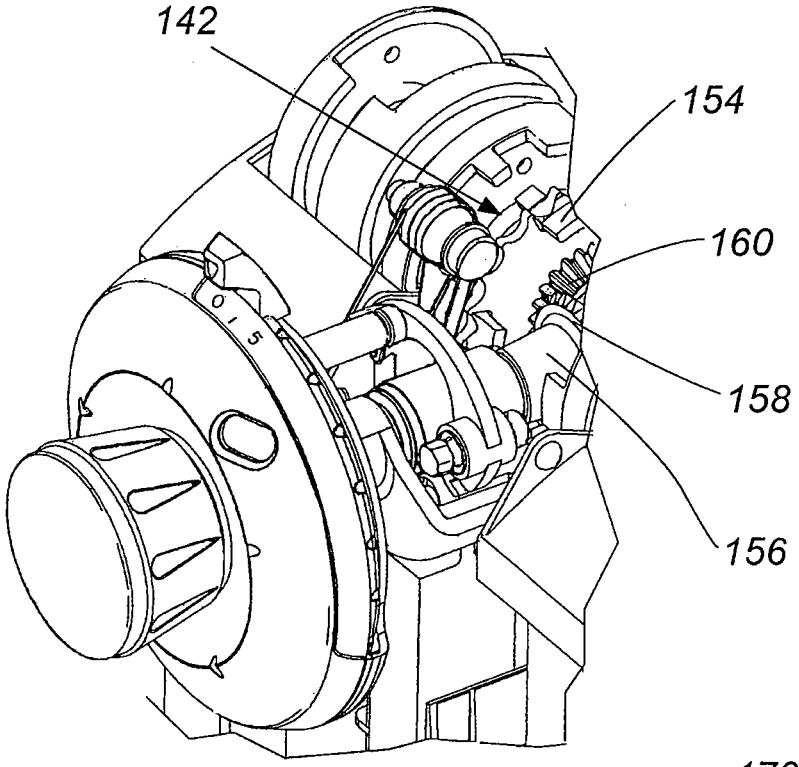
FIG. 4 is a perspective view of a portion of the exercise machine of FIG. 1, showing an enlarged view of the selection mechanism.

Continuing with FIGS. 3 and 6A, the primary and secondary load dials 132, 134 extend from the front end sidewall of the box frame 144 for presentation toward the user for the user's convenience. The primary load dial 132 rotates a first shaft 156 (see FIG. 6B) that extends through the front sidewall of the box frame 144, and is at a right angle to the longitudinal axis of the primary engagement shaft 148. With reference to FIGS. 3 and 4, the first shaft 156 causes the primary engagement shaft 148 to rotate through a bevel gear arrangement. More particularly, a bevel gear 158 positioned on the end of the first shaft 156 engages a beveled gear teeth set 160 formed on a engagement device 142 at a radius inwardly from the peripheral flange 154 also formed thereon, so as to avoid interfering with the movement of the flange 154 during rotation. A locking mechanism is located in the box frame 144, and is interactive with the primary and secondary load dials 132, 134 to prohibit the load dials 132, 134 from being actuated while the weight carriage 112 is lifted off of the support structure 116. The locking mechanism is described in U.S. patent application Ser. No. 13/077,012, entitled "Lockout Mechanism For a Weight Stack Exercise Machine" and filed on Mar. 31, 2011, and U.S. Provisional Patent Application No. 61/319,662, filed on Mar. 31, 2010, and entitled "Lockout Mechanism For a Weight Stack Exercise Machine", which are incorporated herein by reference in their entireties.

The secondary load dial 134 is, in this execution, a lever that allows the user to select between 0 and 5 extra pounds. Actuation of the lever to one position engages the secondary load element 138 with the weight carriage 112, while the actuation of the lever to the other position disengages the second load element 138 from the weight carriage 112.

Figure 5:
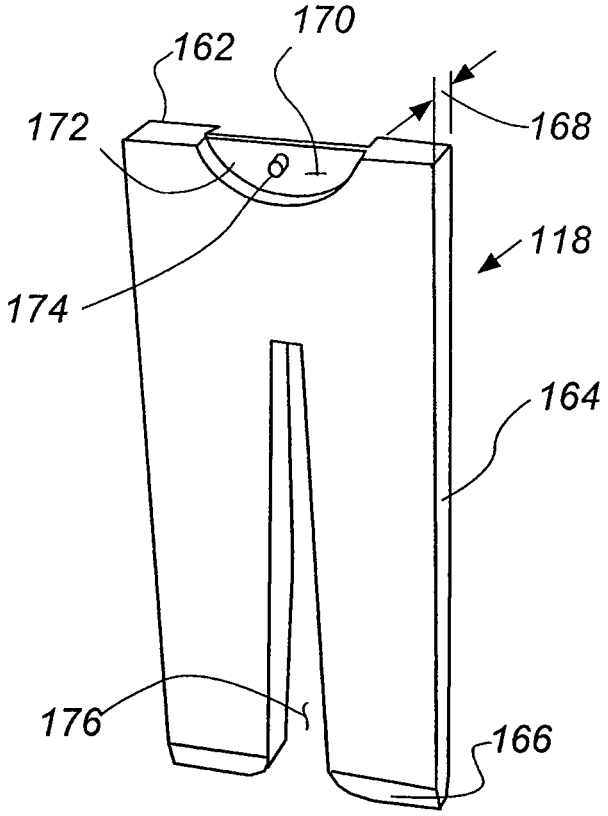
FIG. 5 is a perspective view of an example of a load element that may be used with the exercise machine of FIG. 1.

The exercise machine may include one or more primary load elements 118 and one or more secondary load elements 138. The primary load elements 118 may selectively connected to the weight carriage 112 by the primary engagement mechanism 136, and the secondary load elements 138 may be selectively connected to the weight carriage 112 by the secondary engagement mechanism 140. Referring to FIG. 5, the primary load elements 118 may take the form of weight plates that are generally trapezoidal in shape, having a top edge 162, opposing side edges 164, a bottom edge 166, and a thickness 168 defined between opposing front and rear faces. Each load element 118 is designed to weigh a particular amount as needed for the various load options for the exercise machine.

Along the top edge 162 of a load element 118, about midway between opposing side edges 164, a curved recess 170 is formed on each face of the load element 118. A webbing 172 separates the two recesses 170, and the webbing 172 is narrower than the normal thickness 168 of the load element 118. One or more posts or tabs 174 are positioned to extend orthogonally from the webbing 172. In some embodiments, a single post or tab 174 extends from the webbing 172 from either the front or rear face of the load element 118. In other embodiments, two posts or tabs 174 extend from the webbing 172, one from the front face of the load element 118 and the other from the rear face of the load element 118. When two posts or tabs 174 are utilized, adjacent engagement devices 142 may be used to support the load element 118 on the front and rear sides of the load element 118, as shown, for example, in FIG. 6A, when the load element 118 is joined to the weight carriage 112. The posts or tabs 174 are generally positioned along a symmetrical centerline of the load element 118. The curved recess 170 is intended to generally fit the curvature of the engagement disc that fits in the recess. However, any shaped recess that avoids interference with the engagement discs could be used.

Continuing with FIG. 5, a slot 176 is formed in the bottom edge 166 of the load element 118 and defined by a perimeter edge of the load element 118. The slot 176 extends towards the top edge 162 of the load element 118. The slot 176 ends about one-third short of the top edge 162 of the load element 118. The slot 176 has a first bottom section that is tapered, and a second top section that has parallel sidewalls. Other slot shapes are contemplated. The support beam 116 is shaped and sized to fit in the slot 176 of each load element 118 and engage, via the divider structure 124, the perimeter edge of the load element 118 that defines the top portion of the slot 176 when the load element 118 is fully seated on the support beam 116. Each load element 118 is thus supported from below on the support beam 116 when the weight carriage 112 is in the rest position, or when a particular load element 118 is not selected for engagement to the weight carriage 112 during the exercise. The tapered portion of the slot 176 assists in guiding the load element 118 attached to the weight carriage 112 onto the support beam 116 during the downward motion of the load elements 118 joined to the weight carriage 112 during the exercise stroke.

With reference to FIG. 6B, the divider structure 124 is positioned on the support beam 116 between the beam 116 and the slot 176 of the load elements 118. The load elements 118, which directly contact the divider structure 124, thus engage the support beam 116 via bearing on the divider structure 124, which in turn bears on the support beam 116. In some embodiments, the divider structure 124 may be omitted. In such embodiments, plates or the like may be joined to the support beam 116 and extend upwardly from the support beam 116 to maintain the lateral spacing of the load elements 118 along the support beam 116, and the load elements 118 may be in direct contact with the support beam 116.

The secondary load element 138, best shown in FIGS. 6B and 6C, is positioned to rest on the divider structure 124 below the load dials 132, 134. Specifically, with reference to FIG. 2, a generally U-shaped structure 178 extends from a front face of the divider structure 124. The generally U-shaped structure 178 may be formed from a pair of generally parallel sidewalls that extend from a main body portion of divider structure 124 and an end wall that is positioned between the ends of the sidewalls distal the main body portion of the divider structure 124. The parallel sidewalls of the generally U-shaped structure 178 are spaced apart at a distance slightly greater than the thickness of the second load element 138, thus allowing a portion of the second load element 138 to be received therebetween when the secondary load element 138 rests on the divider structure 124. These sidewalls help maintain the alignment of the secondary load element 138 relative to the weight carriage 112 and the support beam 116.

The end wall of the generally U-shaped structure 178 is sized and configured to be received within a slot defined in the secondary load element 138 and to engage an upper portion of the slot when the weight carriage 112 is in the rest position, or the secondary load element 138 is not selected during an exercise. The slot of the secondary load element 138 is similar to the slots 176 of the primary load elements 118 in structure and function. The divider structure 124, in turn, is supported by the support beam 116, and thus when the secondary load element 138 rests on the divider structure 124 (i.e., the upper portion of the slot of the secondary load element 138 engages the U-shaped structure 178 of the divider structure 124), the secondary load element 138 is also supported from below by the support beam 116. In embodiments that omit the divider structure 124, plates or the other suitable elements for supporting the secondary load element 138 could be used to define a structure similar to the U-shaped structure 178 of the divider structure 124. In such embodiments, these plates may be joined to the support beam 116 by any suitable connection method.

Figure 7A:
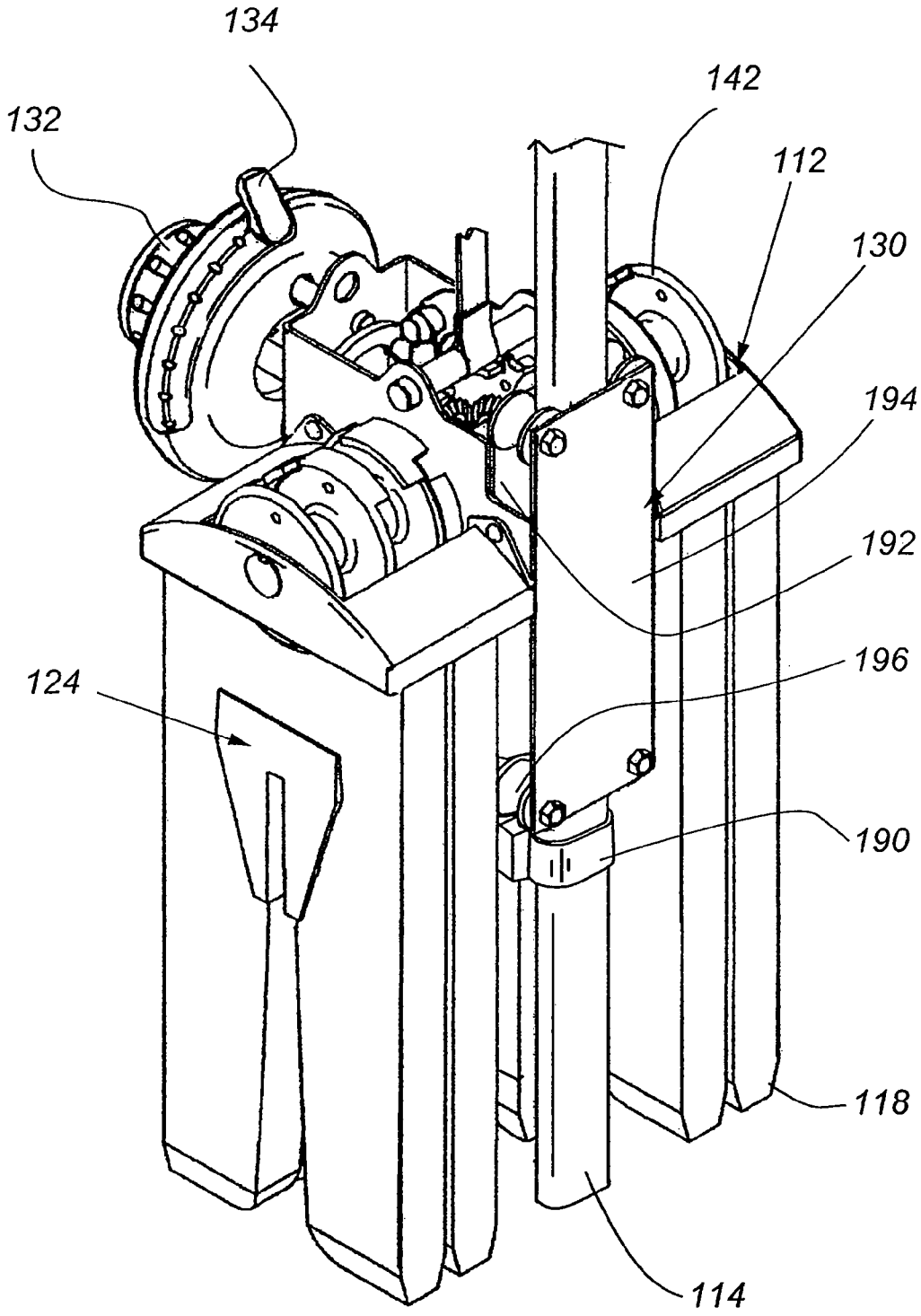
FIG. 7A is another perspective view of a portion of the exercise machine of FIG. 1, showing an enlarged view of the weight carriage and the load elements.
Figure 7B:
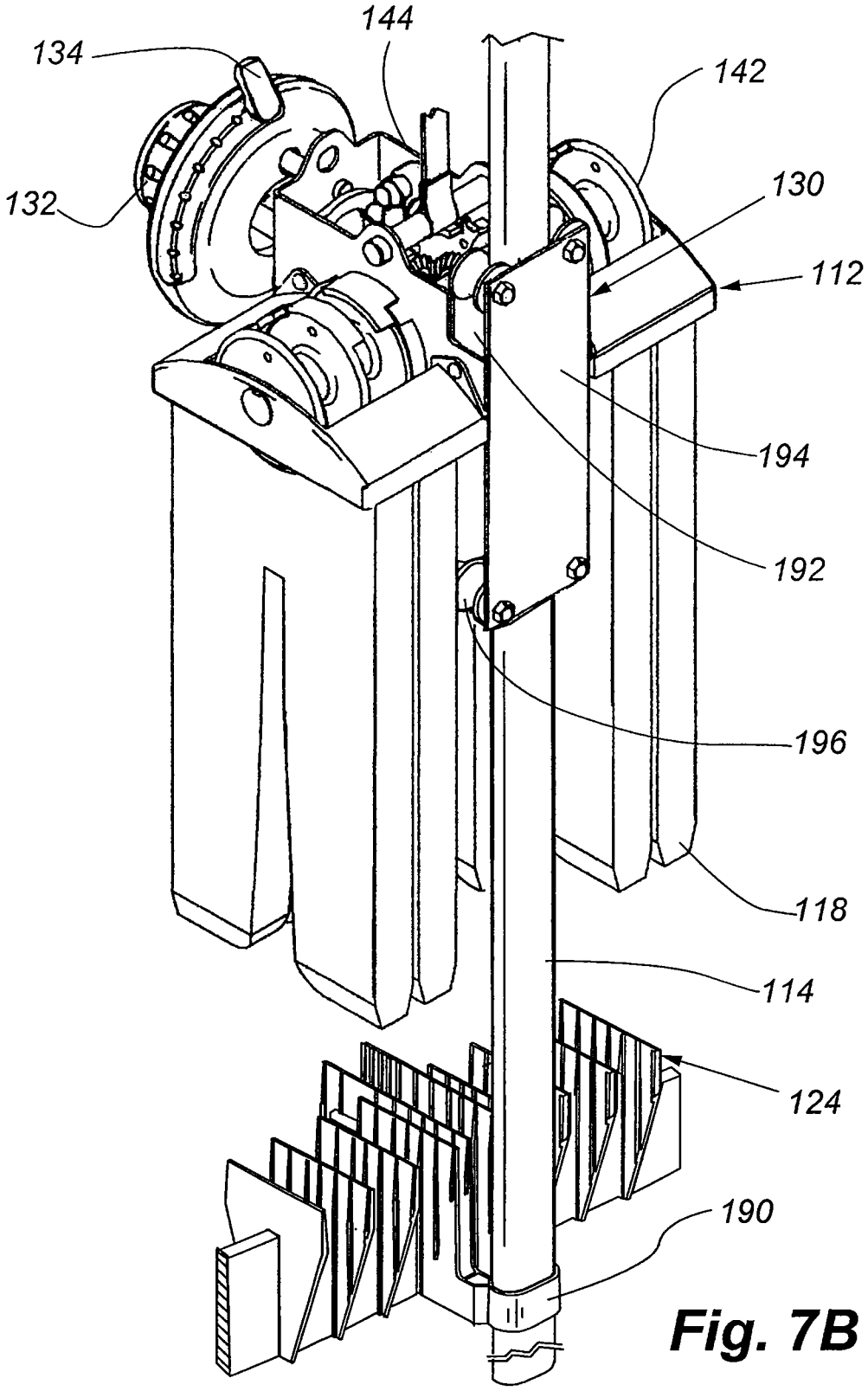
FIG. 7B is a perspective view similar to the view of FIG. 7A, showing the weight carriage moved from its rest position.

With reference to FIGS. 7A and 7B, the divider structure 124 may further include a collar 190 that is joined to a rear side of the main body portion of the divider structure 124. The collar 190 is configured to define a collar opening that receives the guide pole 114 therethrough. The collar 190 helps to reduce the torsional moment imposed on the support beam 116 by the secondary load element 138 as a result of center of gravity of the secondary load element 138 being laterally offset from the longitudinal centerline of the support beam 116 when the secondary load element 138 rests on the divider structure 124.

The secondary load elements 138 may be similar to the primary load elements 118. Like the primary load elements 118, the secondary load elements 138 may take the form of trapezoidal-shaped weight plates that include, as described above, a slot, a top edge portion that has two recesses separated by a narrow flange or webbing, and one or more posts or tabs extending from the webbing. When two posts or tabs are used, one post extends from the front face of the webbing and the other post extends from the rear face of the webbing. To join the secondary load element 138 to the weight carriage 112, the engagement device 142 for the secondary engagement mechanism 140 engages the posts 174 of the second load element 138, as shown, for example, in FIG. 6C.

When the weight carriage 112 is in the rest position and not being moved by the user, the user may select the weight to use during the exercise. By selecting the primary and secondary load elements 118, 138 to join to the weight carriage 112 using the primary and secondary load dials 132, 134 as noted above, the user chooses the desired load. As shown in FIGS. 6A and 6B, the primary and second load elements 118, 138, in this execution, are engaged to the weight carriage 112 by the primary and secondary engagement mechanisms 136, 140, respectively. In particular, when a primary load element 118 is selected for engagement to the weight carriage 112, the flanges 154 on adjacent discs are positioned under the posts 174 extending from the webbing 172 at the top of the selected primary load element 118. When the weight carriage 112 is caused to move upwardly by the user, the flanges 154 engage the posts 174 on both sides of the webbing 172, and lift the primary load element 118 upwardly. If the particular primary load element 118 is not engaged by the flanges 154 on the disc, the load element 118 stays in position on the support beam 116. The same or similar engagement and operation occurs when the secondary load dial 134 is positioned to engage the secondary load element 138.

Referring to FIGS. 7A and 7B, the bearing structure 130 is positioned at the end wall of the box frame 144 opposite the load selection dials 132, 134. The bearing structure 130 movably secures the weight carriage 112 to the single guide post 114 and sufficiently impedes rotational and torsional movement of the weight carriage 112 around the post 114 during use. The bearing structure 130 includes a front plate 192 and a rear plate 194 with bearing rollers 196 positioned between the plates 192, 194 at upper and lower spaced locations. In one execution, as shown in FIG. 7A, a pair of bearing rollers 196 are located at the top corners of the plates 192, 194, and another pair are located at bottom corners of the plates 192, 194. Each pair of bearing rollers 196 traps the short ends of the race-track oval cross section of the guide post 114 between opposing bearing rollers 196. The two pair of bearing rollers 196 are spaced longitudinally apart to help reduce the amount of rotational and torsional movement of the weight carriage 112 around the single guide post 114.

The front plate 192 of the bearing structure 130 may be integral with the rear sidewall of the box frame 144. The opposing rights and left sidewalls of the box frame 144 may extend rearward past the rear sidewall of the box frame 144 to secure to the rear plate 194 of the bearing structure 130 and provide sufficient torsional resistance.

Continuing with FIGS. 7A and 7B, when the weight carriage 112 is moved up and down along the guide post 114, such as during an exercise under the power of a user, there are often one or more primary and/or secondary load elements 118, 138 attached to the weight carriage 112. The weight carriage 112 extends outwardly toward one side of the guide post 114 and creates a moment load on the guide post 114 during this up and down motion. The bearing rollers 196 of the bearing structure 130 engage the guide post 114 and resist the moment load to allow for a smooth rolling movement of the weight carriage 112. The guide post 114 is secured at or near its top and bottom ends to the frame to securely support the guide post 114. The guide post 114 may not extend entirely linearly from the top to the bottom of the frame 102. It may also be curved or otherwise non-linear. The guide post 114 may also be off-vertical, such as extending at least partially at an angle.

Figure 8:
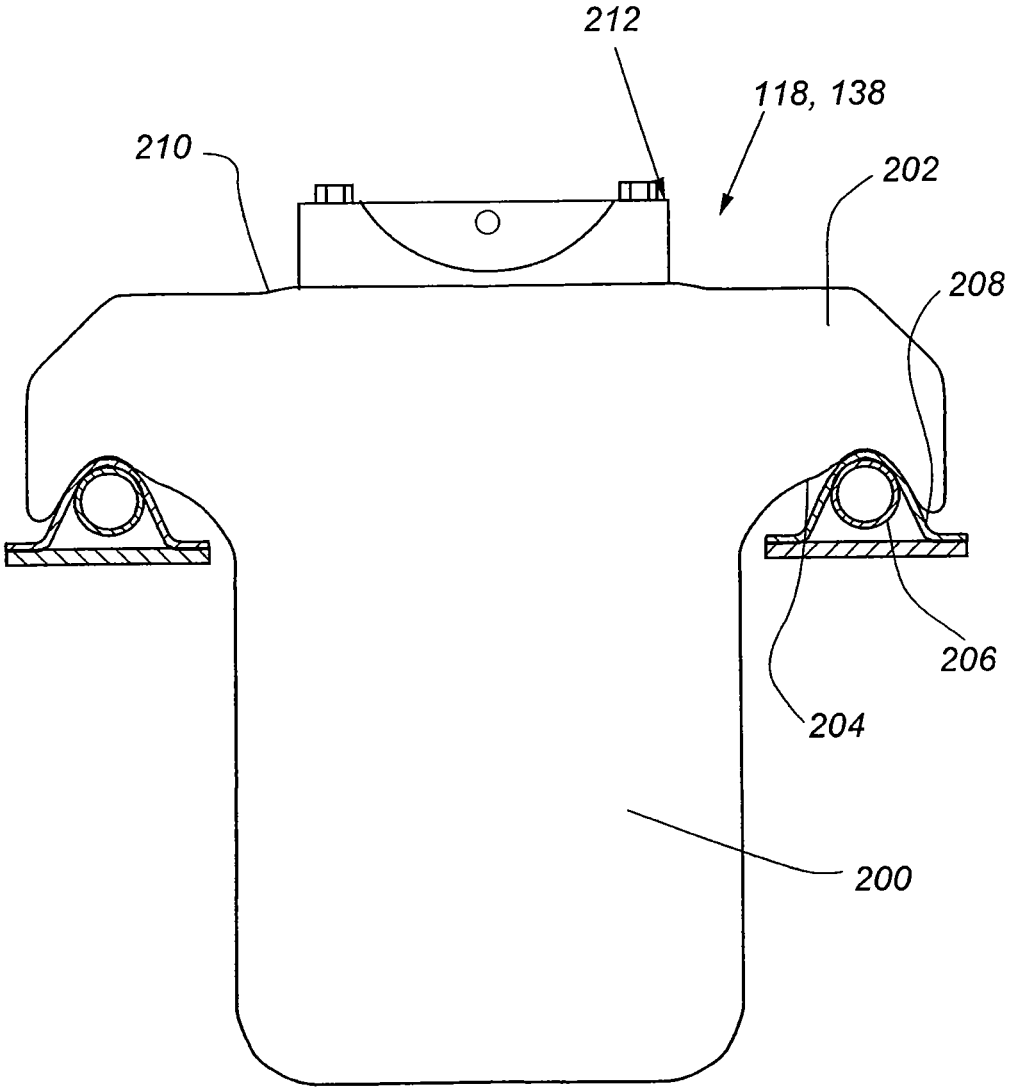
FIG. 8 is a partial cross-section view of another resistance system that may be used with the exercise machine of FIG. 1.

In another execution, the load elements 118, 138 may have a different shape than that described above, with the same or similar engagement features formed along their top edges to allow selection by the engagement devices 142 (discs) as described elsewhere herein. For instance, as shown in FIG. 8, the load elements 118, 138 may take the form of weight plates that have a generally T-shaped front profile formed from a main body portion 200 and two arm portions 202. The arm portions 202 may extend laterally from the main body portion 200. A supporting edge 204 may be provided at the intersection of the arm portions to the body portion. The supporting edge 204 may be shaped to match the shape of a respective support structure 206, such as a support beam or rail, mounted on the frame 102, one support beam for each arm portion 202. The pair of support beams 206 have a curved shape that mate closely with the shape of the load element 118, 138 between the main body portion 200 and the arm portions 202 to form an engagement interface. The shape of the engagement interface between the load elements 118, 138 and the support beams 206 helps center the T-shaped load elements on the frame for accurate and precise location relative to the weight carriage 112. Spacers 208 may be positioned along each of the support beams 206 to aid in laterally positioning the load elements 118, 138 properly along the length of the support beams 206, and to help reduce noise.

A top edge 210 may also be provided extending along the top of the arm portions 202 and across the top of the body portion 200 and an engagement feature 212 may be affixed thereto. In some embodiments, an opening or a recess (not shown) may be provided to adjust the weight of the load element 118, 138 while maintaining a consistent outer profile for the load element 118, 138. The support beams 206 may be spaced just greater than the width of the body portion 200 of the load element 118, 138.

The load elements 118, 138 shown in FIG. 8, while supported by a support beam 206 on each side, are not limited to matching profiles and may be provided with any profile that allows for support by the beams 206. The weight value of any given load element 118, 138 may be adjusted through adjustment of the load element thickness, the load element profile, the material used, and/or through omitting portions from the body portion 200 of the load element 118, 138.

All directional references (e.g., upper, lower, upward, downward, left, right, leftward, rightward, top, bottom, above, below, vertical, horizontal, clockwise, and counterclockwise) are only used for identification purposes to aid the reader's understanding of the examples of the present invention, and do not create limitations, particularly as to the position, orientation, or use of the invention unless specifically set forth in the claims. Joinder references (e.g., attached, coupled, connected, joined, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. Changes in detail or structure may be made without departing from the spirit of the invention as defined in the appended claims. Accordingly the matter contained in the above description or shown in the accompanying drawings shall be interpreted as illustrative only and not limiting.

What is claimed is:

1. An exercise machine comprising:

a user engagement mechanism;

a frame including a first beam;

a weight carriage operably associated with the user engagement mechanism and movably joined to the frame so that the weight carriage moves substantially vertically and linearly relative to the frame in response to movement of the user engagement mechanism;

the weight carriage including a weight engagement mechanism configured to selectively join to the weight carriage a desired combination of load elements selected from a plurality of first load elements;

each of the plurality of first load elements including a perimeter edge defining an engagement surface;

when the weight carriage is positioned in a rest position, each of the plurality of first load elements are positioned in a spaced relationship along a longitudinal axis of the first beam and the engagement surfaces for the plurality of first load elements engage the first beam in such a manner that the first beam supports the weight carriage and the plurality of first load elements; and each of the plurality of first load elements can be disengaged from the first beam independently of the other first load elements by selectively joining the first load element to the weight carriage and moving the weight carriage substantially vertically and linearly relative to the frame from the rest position.

2. The exercise machine of claim 1, further comprising a single guide post operatively associated with the weight carriage.

3. The exercise machine of claim 2, wherein the single guide post is operatively associated with the weight carriage in such a manner that the single guide post constrains the weight carriage to move substantially vertically and linearly relative to the frame.

4. The exercise machine of claim 1, wherein at least one of the plurality of first load elements includes a slot sized to receive the first beam within the slot, and the engagement surface of the first load element defines a portion of the slot.

5. The exercise machine of claim 4, wherein:

the slot extends from a lower end of the first load element to an upper end of the first load element; and the first beam supports the first load element from below.

6. The exercise machine of claim 4, wherein the slot tapers along at least a portion of the slot.

7. The exercise machine of claim 1, further comprising a divider structure positioned on the first beam, the divider structure including a plurality of walls that facilitate positioning the plurality of first load elements along the first beam.

8. The exercise machine of claim 7, wherein at least one of plurality of first load elements is engaged with the first beam by contacting the engagement surface of the first load element with the divider structure.

9. The exercise machine of claim 7, wherein:

the divider structure further includes a collar that defines an opening, and the exercise machine further includes a guide post that passes through the opening of the collar.

10. The exercise machine of claim of 1, further comprising:

a second load element with a center of gravity;

the first beam supports the second load element when the weight carriage is positioned at the rest position; and the center of gravity of the second load element is laterally offset from a longitudinal centerline of the beam.

11. The exercise machine of claim 1, wherein the frame includes a second beam, and when the weight carriage is positioned in the rest position, the second beam supports the weight carriage and each of the plurality of first load elements.

12. The exercise machine of claim 11, wherein the periphery of each of the plurality of first load elements defines a second engagement surface that engages the second beam when the weight carriage is positioned in the rest position.

* * * * *